US008272546B2

(12) United States Patent
Leistensnider

(10) Patent No.: US 8,272,546 B2
(45) Date of Patent: Sep. 25, 2012

(54) BABY CARRIER SUPPORT BELT

(75) Inventor: Beth Warrell Leistensnider, Chicago, IL (US)

(73) Assignee: Catbird Baby, Inc., Chicago, IL (US)

( * ) Notice: Subject to any disclaimer, the term of this patent is extended or adjusted under 35 U.S.C. 154(b) by 481 days.

(21) Appl. No.: 12/548,279

(22) Filed: Aug. 26, 2009

(65) Prior Publication Data

US 2010/0187269 A1 Jul. 29, 2010

Related U.S. Application Data

(60) Provisional application No. 61/190,235, filed on Aug. 27, 2008.

(51) Int. Cl.
*A47D 13/08* (2006.01)
*A47D 13/02* (2006.01)

(52) U.S. Cl. ..... 224/158

(58) Field of Classification Search ..... 224/158–160, 224/673; D3/214
See application file for complete search history.

(56) References Cited

U.S. PATENT DOCUMENTS

| | | | | |
|---|---|---|---|---|
| 3,197,100 | A | 7/1965 | Thompson | |
| 3,481,517 | A | 12/1969 | Aukerman | |
| 4,402,440 | A | 9/1983 | Purtzer et al. | |
| D276,478 | S | 11/1984 | Fallon | |
| 4,986,458 | A | 1/1991 | Linday | |
| 5,205,450 | A * | 4/1993 | Derosier | 224/161 |
| 5,673,828 | A * | 10/1997 | Raedel et al. | 224/160 |
| 5,934,528 | A * | 8/1999 | Higuchi | 224/159 |
| 5,950,896 | A | 9/1999 | Theodore | |
| D425,696 | S | 5/2000 | Swanke | |
| 6,595,396 | B2 | 7/2003 | Cummings et al. | |
| D506,310 | S | 6/2005 | Kassai et al. | |
| 7,168,600 | B2 | 1/2007 | Hwang | |
| 7,252,214 | B2 | 8/2007 | Krogh | |
| 7,322,498 | B2 | 1/2008 | Frost | |
| 2005/0051582 | A1 | 3/2005 | Frost | |
| 2006/0076373 | A1 | 4/2006 | LaBelle et al. | |
| 2006/0289572 | A1 * | 12/2006 | Hayden | 224/153 |

* cited by examiner

*Primary Examiner* — Justin Larson
*Assistant Examiner* — Adam Waggenspack
(74) *Attorney, Agent, or Firm* — McCracken & Frank LLC

(57) ABSTRACT

A support belt which includes openings to connect with and attach to the waist support of existing mei tai baby carriers. The support belt further comprises padding within its inner components and vertical stitching to enable the belt to fold to allow it to encircle the waist of a wearer. The support belt can also include attachments such as a child harness, as well as storage and attachment elements for storing and connecting additional items.

20 Claims, 7 Drawing Sheets

BABY CARRIER SUPPORT BELT

CROSS-REFERENCE TO RELATED APPLICATION

This application claims priority to and the benefit of the filing date of U.S. Provisional Application Ser. No. 61/190,235 filed Aug. 27, 2008 and entitled "Baby Carrier", the entire contents of which are incorporated herein by reference.

FIELD OF THE INVENTION

The present invention generally relates to the field of child carriers and, more particularly, to a support belt which can be attached to the waist support of existing child carriers.

BACKGROUND OF THE INVENTION

There exists child carriers which permit a wearer to carry an infant while giving the infant freedom of arm and hand movements. While these child carriers may be adequate for newborn babies, they are not well adapted for use with larger babies or toddlers. The weight of these larger children can put undue strain on the body of the wearer, leading to muscle strain, neck and back injuries. This can also lead to the child carrier wearing down more quickly than intended.

Therefore there is a need for a device which helps to alleviate the strain placed on a wearer's body and extends the life of existing child carriers.

SUMMARY OF THE INVENTION

Embodiments of the present invention generally provide for a support belt which can be securely attached to an existing child carrier such as a straight waist mei tai. The belt can include padded foam support and soft-structured design to help transfer the baby's weight to the carrier's hips and lower body. The support belt also aids in weight distribution to the hips and thighs with heavy babies or toddlers. Another advantage of the current invention is that it can also help extend the life of existing carriers when in use with a heavier toddler.

The invention is also flexible enough to accommodate for a smaller toddler as well. The support belt can include a child harness attachment which connects to the support belt to secure smaller children.

DETAILED DESCRIPTION OF THE PREFERRED EMBODIMENT

Figure 1:
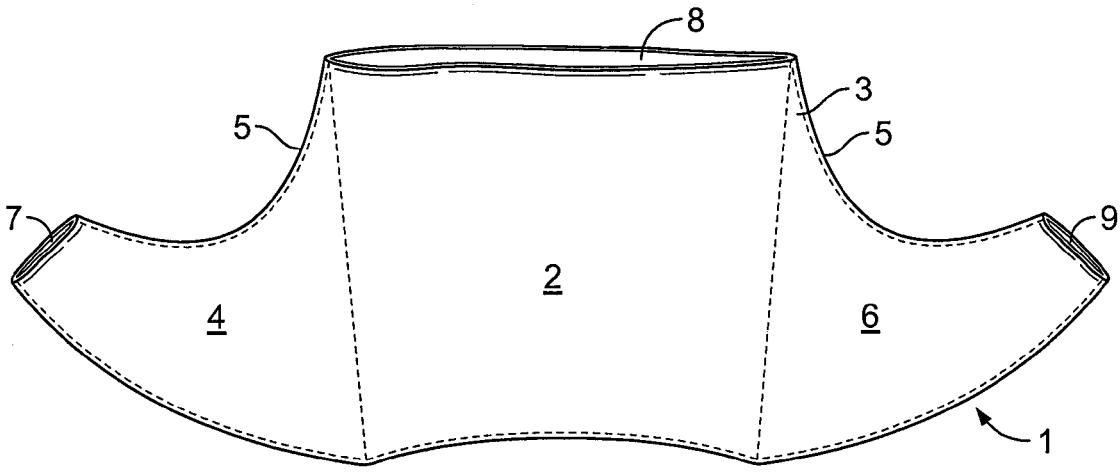
FIG. 1 is a front view of the support belt.

While the present invention is susceptible of embodiments in various forms, there is shown in the drawings and will hereinafter be described some exemplary and non-limiting exemplification for the invention and is not intended to limit the invention to the specific embodiments illustrated.

FIG. 1 is a perspective view of an embodiment of the support belt 1. As shown in FIG. 1, the support belt 1 is made up of an inner padding component and an outer fabric 3. In one embodiment, this padding component can be a foam padding material. In yet another embodiment, the outer fabric can be made of a waterproof material. The belt contains three sections, a middle section 2, left section 4, and right section 6, with secure stitching between each section. Stitching between the left 4 and middle 2, and middle 2 and right sections 6 enable the belt 1 to fold to allow it to encircle the waist of the wearer more comfortably.

Figure 5:
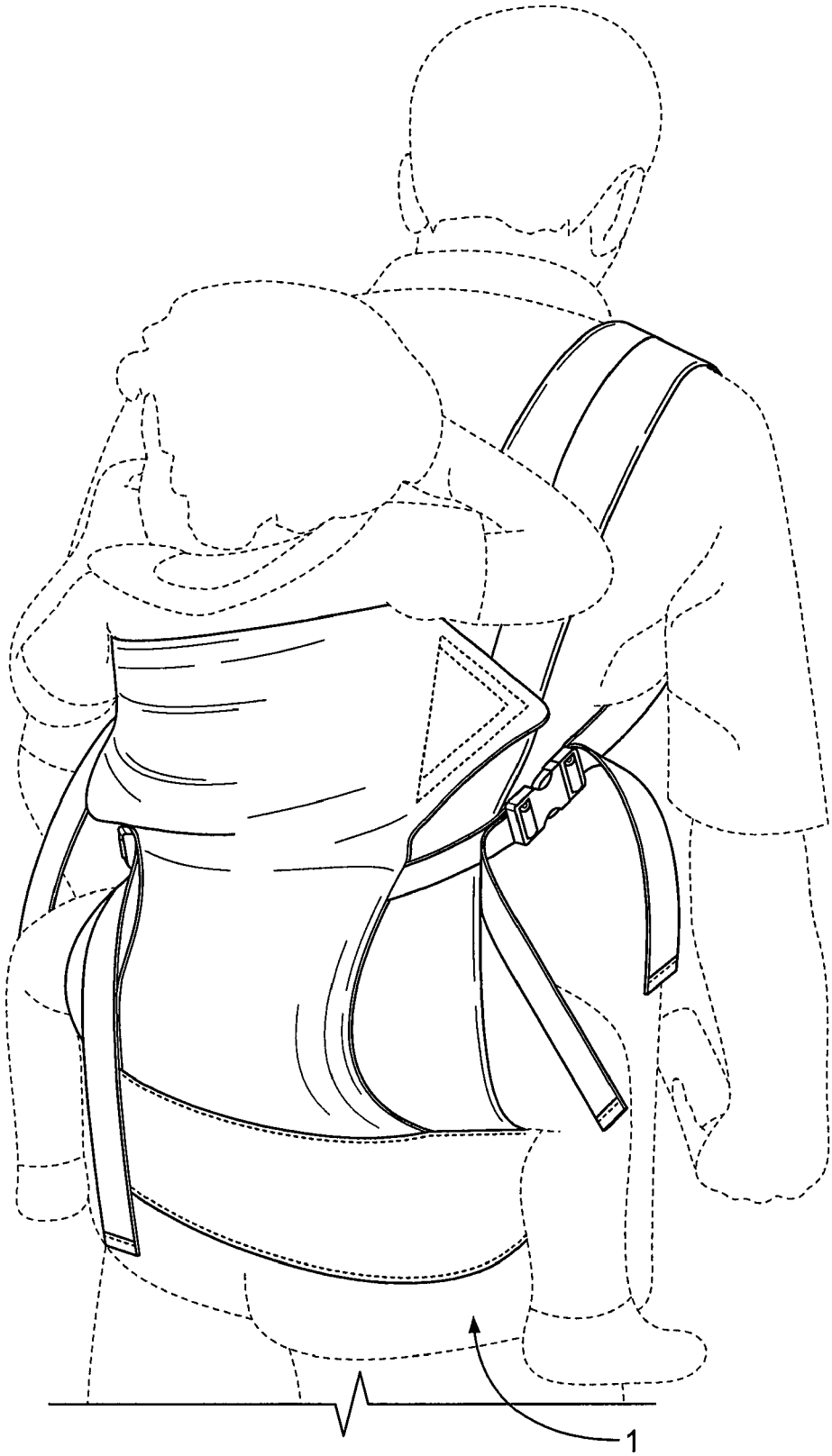
FIG. 5 is a perspective view illustrating the belt, which is attached to a carrier, being worn along the waist of a wearer with a child seated in the carrier.

Further, the left 4 and right 6 sections have a curved shape 5 which allows for a child's legs to rest comfortably and securely during use. FIG. 5 shows an illustration of how this curved shape 5 allows for a child's legs to rest upon the support belt 1 during use.

The top of the belt 1 has an opening 8 that leads down into the interior of the belt wherein a fabric channel is formed extending to both the left 4 and right sections 6 from the center. These channels terminate at the far right and far left sides with openings 7, 9 through which the waist straps 11, 16 of a baby carrier will be threaded. In one embodiment, the belt is shaped such that it is slightly concave at the center to alleviate pressure on the stomach of the wearer. In another embodiment, the support belt 1 includes a fastener which allows additional objects to be secured to the support belt 1. This fastener can be in the form of hook and eye fasteners, buttons, snaps, hooks, buckles, clasps, clips, latches, ties, closures, or pins. Along with fasteners, storage compartments can also be incorporated into the support belt. Examples of these include pockets, compartments, pouches, or slots.

Figure 2:
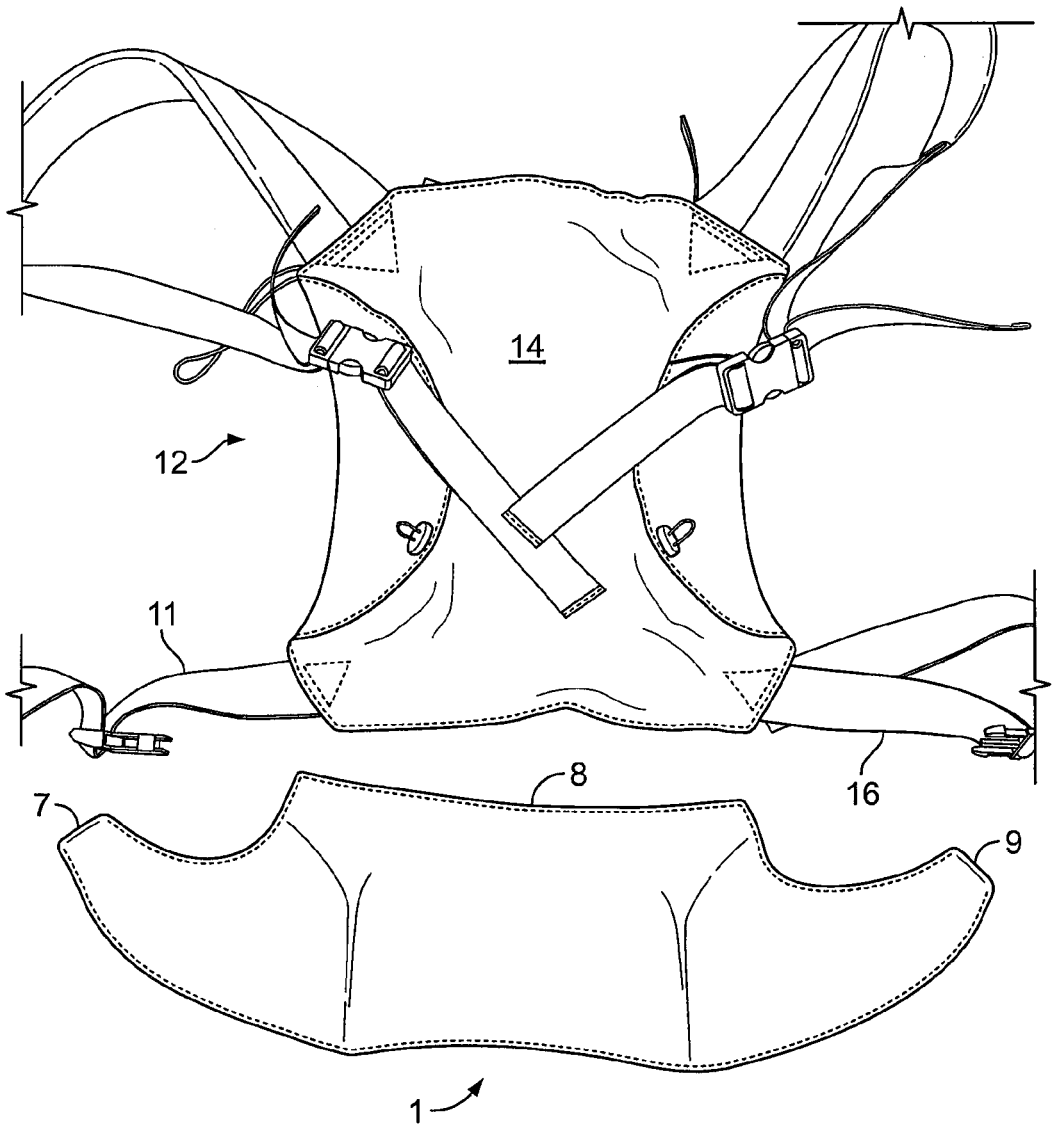
FIG. 2 is a partial front view of a typical mei tai carrier and support belt separated from each other.

The current invention will work with any mei tai or mei tai-style buckle carrier. FIG. 2 shows how to use one embodiment of the support belt 1 in combination with a typical mei tai baby carrier 12. To combine the mei tai carrier 12 with the support belt 1, a user would lay the belt 1 out flat in front of herself/himself with the fabric channels and openings 7, 8, 9 facing up. The mei tai carrier 12 would be laid out, interior side 14 up, just above the belt 1. The wearer would take the left side 11 of the mei tai carrier's waist strap and thread it first through the top opening 8 of the belt 1 and then through the left opening 7 of the support belt's fabric channel, until the waist strap exits via that left opening 7. The process would be repeated with the right waist strap 16 and top 8 and right 9 openings of the fabric channel.

Figure 3:
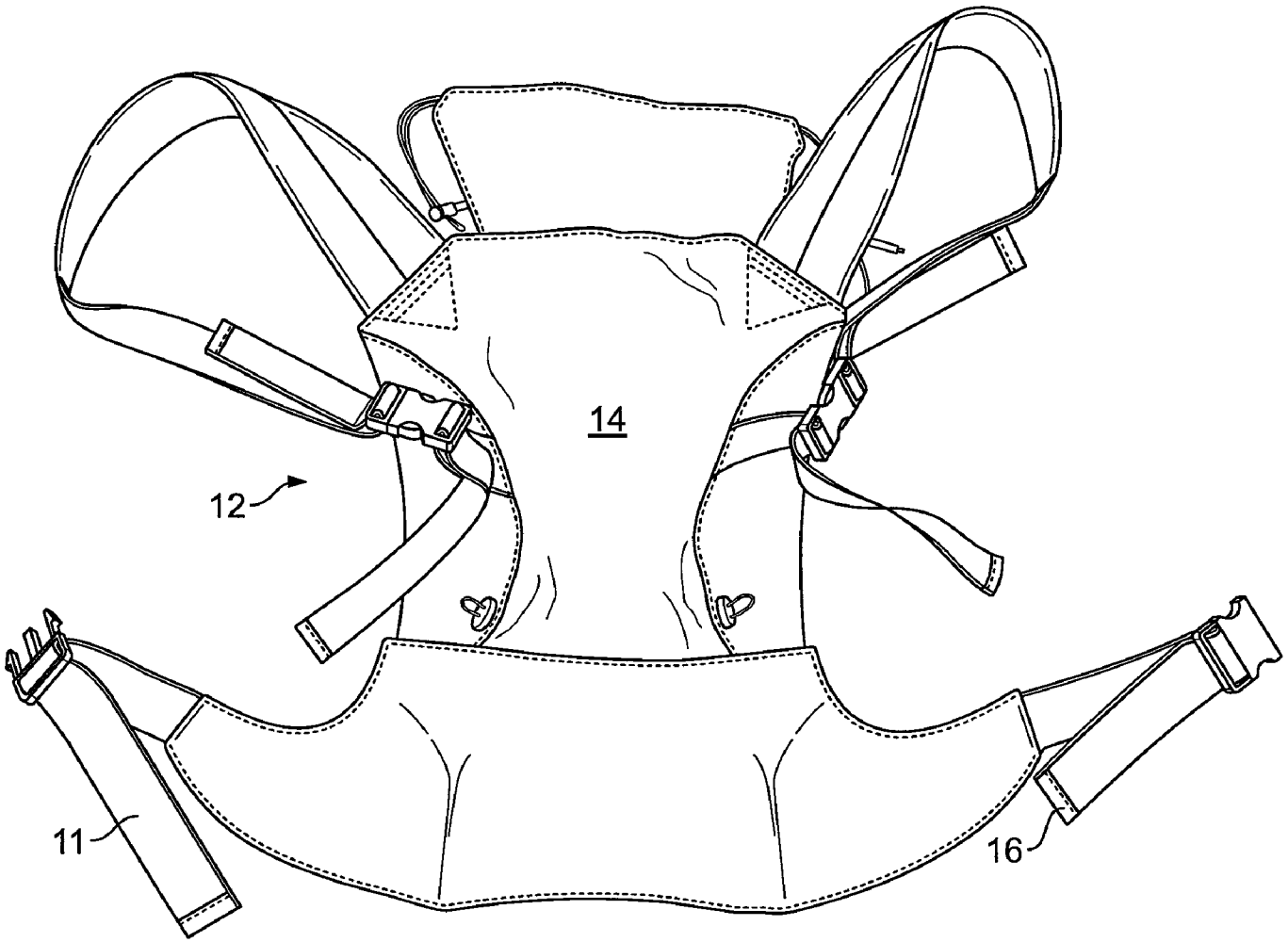
FIG. 3 is a front view of a typical mei tai carrier and support belt combined together.
Figure 4:
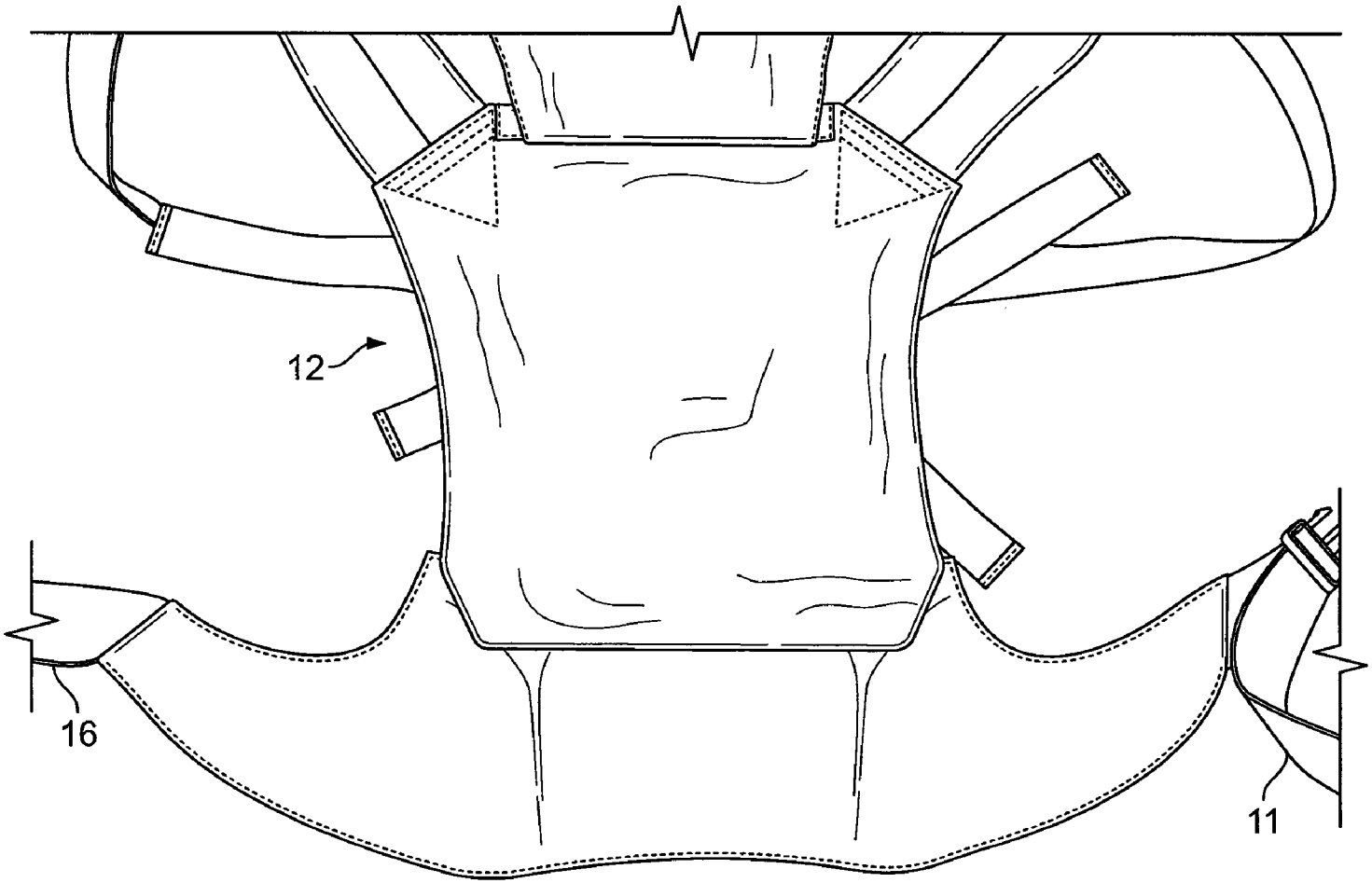
FIG. 4 is a partial back view of a typical mei tai carrier and support belt combined together.

FIGS. 3 and 4 show front and back views respectively of how the support belt 1 would look with a mei tai carrier 12 inserted into it.

Figure 6:
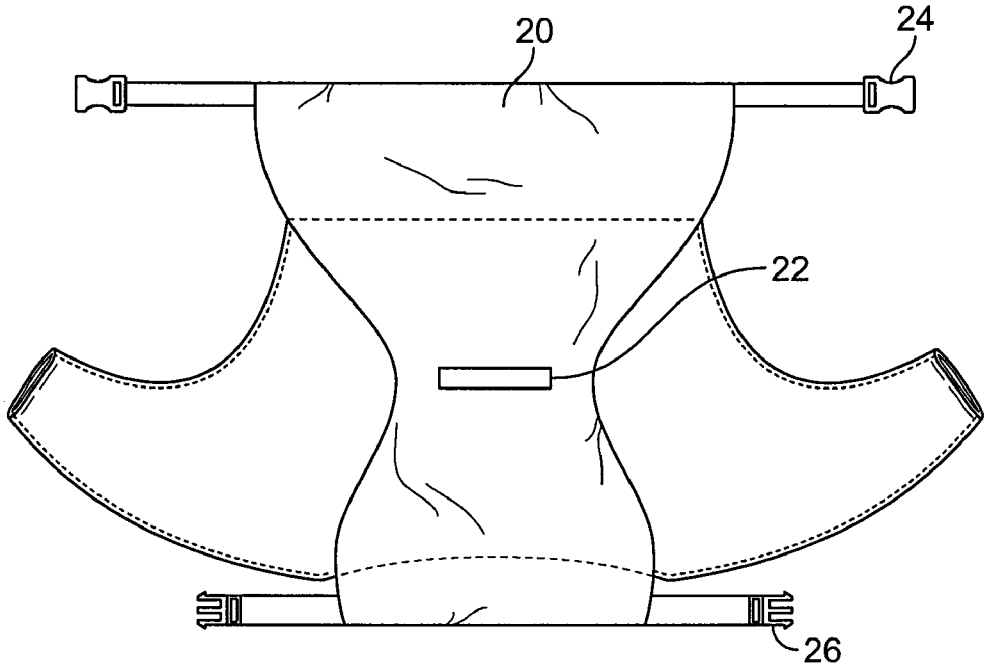
FIG. 6 is a front view of the support belt with a harness attachment shown open.

FIG. 6 shows an additional embodiment of the support belt 1 with a child harness attachment 20. The side edges of the child harness 20 are cut into a curved shape to allow for a child's legs to hang comfortably from the harness 20. The child harness 20 has two opposing ends and at each of these ends, there are strips of webbing with interlocking connectors 24, 26 extending from each side of the ends.

The child harness 20 is also made up of an inner padding component and an outer fabric. In one embodiment, this inner padding can be a foam padding material and is placed inside of the outer fabric. In yet another embodiment, the outer fabric can be made of a waterproof material.

In FIG. 6, the harness 20 is shown attached to the support belt 1 by a hook and eye type fastener 22. However, other attachment elements, including but not limited to the following may also be used: buttons, snaps, hooks, buckles, clasps, clips, latches, ties, closures, and pins.

Figure 7:
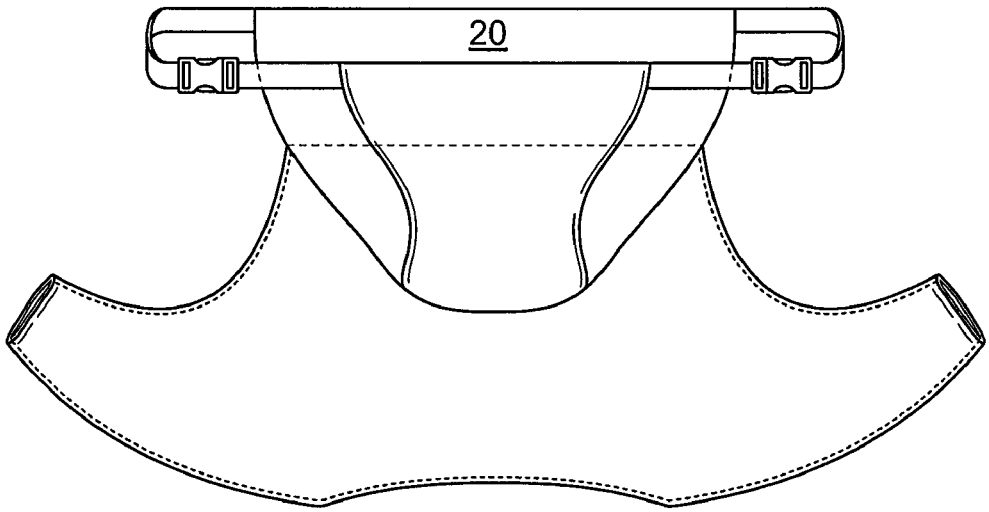
FIG. 7 is a front view of the support belt with a harness attachment shown closed.

To use the child harness 20, a user would attach the support belt 1 to a mei tai or mei tai-style buckle carrier. Then the user would attach the harness 20 to the support belt 1 by the fastener 22. Next the user would fold up the harness 20 and connect the female end of the buckle 24 with the male end of the buckle 26 to securely hold the child who will be placed within the harness 20. FIG. 7 shows a view of the harness 20 with the buckles attached.

Figure 8:
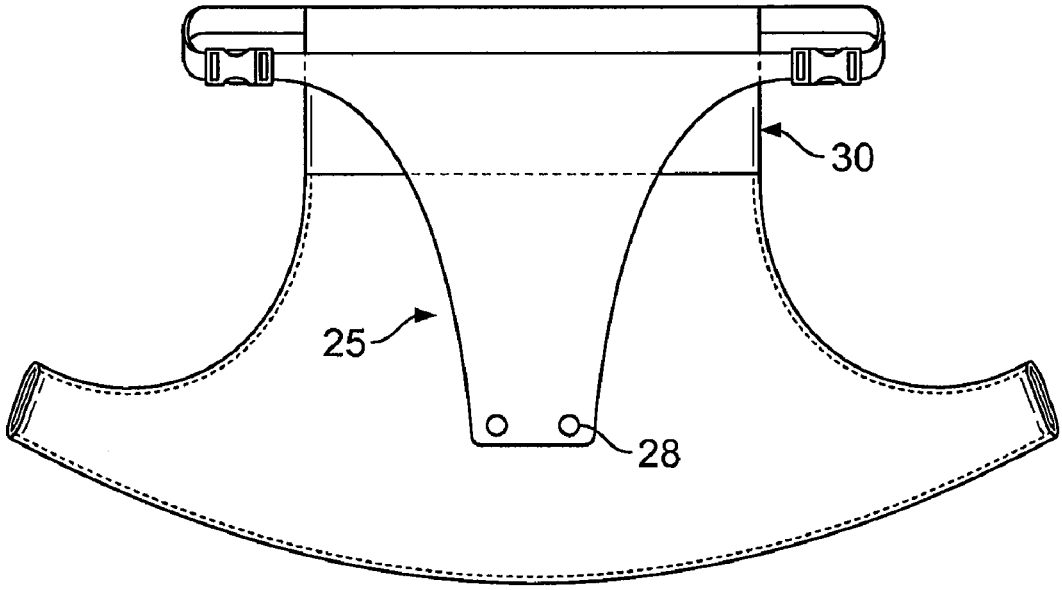
FIG. 8 is a front view of the support belt with an alternative harness attachment.

FIG. 8 shows yet another embodiment of the support belt 1. In this embodiment, the support belt 1 is attached to a child harness attachment 25. The child harness 25 has a top end which is wider than the bottom end. The top of the child harness 25 also has strips of webbing which extend from opposing sides of the top end. At the end of these strips of webbing are fastening elements such as buckles, as shown in FIG. 8. The bottom end of the child harness 25 is attached to the support belt via fasteners 28 such as heavy metal snaps. While heavy metal snaps are shown in FIG. 8, other fastening elements, including but not limited to hook and eye fasteners, buttons, hooks, buckles, clasps, clips, latches, ties, closures, and pins may also be used.

The edges from the top end of the harness 25 to the bottom end of the harness define side edges. These side edges of the child harness 25 are cut into a curved shape to allow for a child's legs to hang comfortably from the harness 25.

The child harness 25 is also attached to a piece of fabric 30, which extends vertically beyond the support belt. This additional height provided by the fabric extension piece 30 helps cover more of the child and adds support for the child.

The fabric extension piece 30 has a top, bottom and opposing sides. There are strips of webbing which extend from opposing sides of the top of the fabric extension piece 30. At the end of these strips of webbing are fastening elements, such as buckles, as shown in FIG. 8. The buckles of the fabric extension piece 30 interlock with the buckles of the child harness to form a secure connection.

In one embodiment, the child harness 25 is also made up of an inner padding component and an outer fabric covering. In one embodiment, this inner padding can be a foam padding material is in placed within the outer fabric. In yet another embodiment, the outer fabric can be made of a waterproof material. Similarly, the fabric extension piece 30 can also comprise an inner foam padding material and can be made of a waterproof material.

To use the child harness 25 shown in FIGS. 8 and 9, a user would again attach the support belt 1 to a mei tai or mei tai style-buckle carrier. Next, the user would attach the child harness 25 to the support belt 1 using an attachment element such as heavy metal snaps 28. Then the user would insert the fabric extension piece 30 into the top opening 8 of the support belt 1. Finally, the user would connect the male and female ends of the buckles between the support belt 1 and fabric extension piece 30 together to hold the child that is to be placed within the harness 25 securely.

Figure 9:
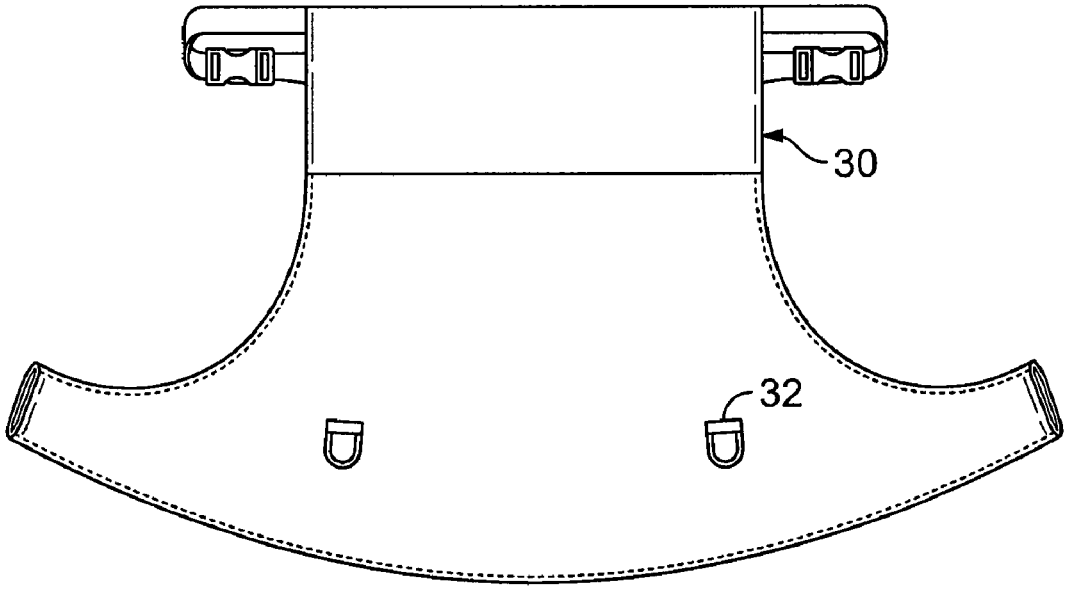
FIG. 9 is a back view of the support belt with an alternative harness attachment.

FIG. 9 shows the rear view of the support belt 1 with harness attachment 20 shown in FIG. 8. This view shows that fasteners 32 such as D-ring type clips can be added to the support belt to allow for the attachment of additional items. Examples of other fasteners which can be used include but are not limited to hook and eye fasteners, buttons, snaps, hooks, buckles, clasps, clips, latches, ties, closures, and pins. Along with fasteners, storage compartments can also be incorporated into the support belt. Examples of these include pockets, compartments, pouches, or slots.

In yet several other embodiments, additional accessories can be included to provide benefits for the user and/or the baby being supported. It is possible to add a webbing and buckle combination threaded through the belt channels so that it can be used with a carrier that does not have waist straps, such as the traditional Korean carrier called a podegi. Since carriers such as a podegi do not have waist straps to combine with the support belt 1, the additional webbing and buckle combination will allow the support belt 1 to securely encircle the user and child.

Materials can vary depending on the specific application. More or fewer openings may be provided in the support belt 1 to accommodate baby carriers which have a varying number of waist straps. A variety of color schemes and patterns can be used for different embodiments. The support belt 1 can be constructed of any material which complies with the laws and safety requirements of any geographical region in which it will be sold or used.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiments. The invention extends to any novel one, or any novel combination, of the features disclosed in this specification (including any accompanying claims, abstract and drawings), or to any one, or any novel combination, of the steps of any method or process so disclosed.

I claim:

1. A support belt comprising:

a rectangular middle portion having a top, opposing sides and a bottom, the top and opposing sides of the middle portion being open and the bottom of the middle portion being closed;

left and right portions disposed adjacent to the opposing sides of the middle portion, wherein the left and right portions extend away from the middle portion in opposite directions and wherein a side of the left and right portions adjacent to the top defines a curve between the top and distal ends of the left and right portions;

a belt channel that extends through the left and right portions wherein an opening in the top of the middle portion extends downwards through the middle portion and continues through the belt channel and open distal ends of the left and right portions;

a padding material enclosed in the support belt; and stitching in the support belt between the left and middle portion and between the right and middle portion thereby defining three distinct portions.

2. A support belt as in claim 1 wherein the support belt comprises a waterproof material.

3. A support belt as in claim 1 wherein the padding material further comprises a foam padding material.

4. A support belt as in claim 1 wherein the support belt has at least one attachment element for securing additional objects to the support belt.

5. A support belt as in claim 4 wherein the attachment element for securing additional objects to the support belt further comprises one of a group including hook and eye fasteners, buttons, snaps, hooks, buckles, clasps, clips, latches, ties, closures, and pins.

6. A support belt as in claim 1 further comprising a webbing and buckle combination threaded through the opening and belt channel for use with a baby carrier which does not use waist straps.

7. A support belt as in claim 1 wherein the support belt is slightly concave at its center.

8. A support belt as in claim 1 wherein the support belt has at least one storage element within the support belt selected from at least one of a pocket, compartment, pouch, or slot.

9. A support belt comprising:

a rectangular middle portion having a top, opposing sides and a bottom, the top and opposing sides of the middle portion being open; a belt channel formed through left and right portions extending from the opposing sides of the middle portion wherein a side of the left and right portions adjacent to the top defines a curve between the top and distal ends of the left and right portions and wherein the top of the middle portion defines an open channel that extends downwards through the middle portion and continues through the open distal ends of the left and right portions and wherein the bottom of the middle portion is closed;

a padding material enclosed within the support belt;

stitching in the support belt; and a child harness having a proximal end adjacent to the top of the rectangular middle portion of the support belt, a distal end adjacent to the bottom of the rectangular middle portion of the support belt, and opposing sides, wherein the center of the area bounded by the proximal and distal ends and opposing sides of the child harness is attached to the center of the support belt; wherein the opposing sides of the child harness define a curve between the proximal and distal end, and wherein the proximal end, distal end and opposing sides of the child harness are closed;

a padding material enclosed within the child harness;

at least one attachment element for connecting the child harness to the support belt;

at least one strip of webbing extending from opposing sides of the proximal end of the child harness;

at least one strip of webbing extending from opposing sides of the distal end of the child harness; and at least one connecting element for fastening the strips of webbing at the proximal of the child harness to the strips of webbing at the distal end of the child harness.

10. A support belt as in claim 9 wherein the attachment element used for connecting the child harness to the support belt and the connecting element used for fastening the strips of webbing together further comprises one of a group including hook and eye fasteners, buttons, snaps, hooks, buckles, clasps, clips, latches, ties, closures, and pins.

11. A support belt as in claim 9 wherein the support belt has at least one attachment element for securing additional objects to the support belt.

12. A support belt as in claim 9 wherein the padding material further comprises a foam padding material.

13. A support belt as in claim 9 wherein the child harness comprises a waterproof material.

14. A support belt as in claim 9 further comprising a webbing and buckle combination threaded through the belt channels for use with a baby carrier which does not use waist straps.

15. A support belt comprising:

a rectangular middle portion having a top, opposing sides and a bottom, the top and opposing sides of the middle portion being open; a belt channel formed through left and right portions extending from the opposing sides of the middle portion wherein a side of the left and right portions adjacent to the top defines a curve between the top and distal ends of the left and right portions and wherein the top of the middle portion defines an open channel that extends downwards through the middle portion and continues through the open distal ends of the left and right portions and wherein the bottom of the middle portion is closed;

a padding material enclosed within the support belt;

vertical stitching in the support belt; and a child harness having a top, opposing sides and a bottom; left and right sides of the child harness which define a curve between the top and bottom and wherein the top, bottom and opposing sides of the child are closed;

a padding material enclosed within the child harness;

at least one attachment element for connecting the child harness to the support belt;

a fabric backing, having a top, opposing sides and a bottom, said fabric backing which when inserted into the top of the support belt, extends vertically beyond the support belt;

at least one strip of webbing extending from opposing sides of the top of the child harness;

at least one strip of webbing extending from opposing sides of the top of the fabric backing; and at least one connecting element for fastening the strips of webbing at the top of the child harness to the strips of webbing at the top of the fabric backing.

16. A support belt as in claim 15 wherein the attachment element used for connecting the child harness to the support belt and the connecting element used for fastening the strips of webbing at the top of the child harness together with the strips of webbing at the top of the fabric backing further comprises one of a group including hook and eye fasteners, buttons, snaps, hooks, buckles, clasps, clips, latches, ties, closures, and pins.

17. A support belt as in claim 15 wherein the support belt has at least one attachment element for securing additional objects to the support belt.

18. A support belt as in claim 15 wherein the padding material further comprises a foam padding material.

19. A support belt as in claim 15 wherein the child harness further comprises a waterproof material.

20. A support belt as in claim 15 further comprising a webbing and buckle combination threaded through the belt channels for use with a baby carrier which does not use waist straps.

* * * * *